US005086876A

United States Patent [19]

Severson

[11] Patent Number: 5,086,876

[45] Date of Patent: Feb. 11, 1992

[54] FOOT ACTUATED LADDER BRACE

[76] Inventor: Gary E. Severson, 1903 - First Avenue SW., Rochester, Minn. 55902

[21] Appl. No.: 691,467

[22] Filed: Apr. 26, 1991

[51] Int. Cl.[5] ..... E06C 5/36; E06C 7/42

[52] U.S. Cl. ..... 182/172; 182/107

[58] Field of Search ..... 182/172, 107, 108, 170

[56] References Cited

U.S. PATENT DOCUMENTS

| | | | |
|---|---|---|---|
| 530,374 | 12/1894 | Wilkins . | |
| 840,365 | 1/1907 | Pease . | |
| 2,196,640 | 4/1940 | Meier . | |
| 2,574,286 | 11/1951 | Rein . | |
| 3,012,628 | 12/1961 | Zumbaum . | |
| 3,025,926 | 3/1962 | Vives . | |
| 3,435,912 | 4/1969 | Scherer . | |
| 3,508,628 | 4/1970 | Conrad | 182/172 |
| 4,519,477 | 5/1985 | Ralston . | |
| 4,632,220 | 12/1986 | Murrell . | |
| 4,723,629 | 2/1988 | Vanden Hoek et al. . | |
| 4,798,262 | 1/1989 | Margolie | 182/107 |
| 4,899,849 | 2/1990 | Levi et al. . | |
| 4,964,488 | 10/1990 | Stewart | 182/172 |

*Primary Examiner*—Reinaldo P. Machado
*Attorney, Agent, or Firm*—Palmatier & Sjoquist

[57] ABSTRACT

A Foot actuated ladder brace for stabilizing ladders with side rails operates by increasing the ladder base width. A channel shaped foot link is pivotally connected to the bottom of one of the ladder side rails as to fold up along the side rail and to swing downwardly to extend along and increase the ladder base. A smaller channel shaped intermediate link adapted to nest within the foot link has a foot end pivotally connected to the outer end of the foot link. The intermediate link has an inward end which is pivotally connected to the outer end of the smallest channel shaped ladder link which is adapted to nest within the intermediate link. The ladder link has a ladder end pivotally connected to the side rail above the bottom of the rail. A foot actuated extending, locking and folding means is provided for extending the foot link from its folded up position to its extended position along the ladder base, for rigidly interlocking the links together, for releasing the interlocked links and for nesting and folding the links upwardly along the side rail.

15 Claims, 3 Drawing Sheets

FOOT ACTUATED LADDER BRACE

BACKGROUND OF THE INVENTION

This invention relates to a brace for stabilizing ladders to reduce shaking, tipping and to improve balance. More particularly, this invention relates to a foot actuated ladder brace for stabilizing various types of ladders with side rails by increasing the ladder base width.

The many varieties and uses of ladders are obvious. Step ladders are used for reaching overhead objects and often somewhat high places that are still typically less than one story high. Extension ladders are also common and are represented by two slidably interconnected ladder pieces that permit telescopic extension of the ladder upwardly and downwardly. Extension ladders are typically used by leaning against a building or the like and reaching well above one and two stories.

A major cause of accidents in association with ladders is due to their lack of stability and shakiness. Ladders have a relatively small base in comparison to the high center of gravity when a person has climbed considerably upward on the ladder. Consequently, ladders are prone to shaking and subject to tipping or falling backward or sideways when an individual attempts to begin work on a ladder such as by reaching outward.

There is a need for a foldable, simple foot actuated ladder brace that will increase the ladder base of any existing ladder to reduce shaking, improve balance and stabilize the ladder.

SUMMARY OF THE INVENTION

A Foot actuated ladder brace for stabilizing ladders with side rails operates by increasing the ladder base width. A channel shaped foot link is pivotally connected to the bottom of one of the ladder side rails as to fold up along the side rail and to swing downwardly to extend along and increase the ladder base. A smaller channel shaped intermediate link adapted to nest within the foot link has a foot end pivotally connected to the outer end of the foot link. The intermediate link has an inward end which is pivotally connected to the outer end of the smallest channel shaped ladder link which is adapted to nest within the intermediate link. The ladder link has a ladder end pivotally connected to the side rail above the bottom of the rail. A foot actuated extending, locking and folding means is provided for extending the foot link from its folded up position to its extended position along the ladder base, for rigidly interlocking the links together, for releasing the interlocked links and for nesting and folding the links upwardly along the side rail.

A principal object and advantage of the present invention is that the ladder brace is foot actuated requiring no use of the hands which otherwise may hold the ladder or place the ladder in place while the ladder brace is extended or folded up with the foot.

Another principle object and advantage of the present invention is that the ladder brace is simple, adaptable for existing ladders as well as new ladders, light weight, strong, durable, compact and folds into a relatively small space.

Another object and advantage of the present invention is that it is simply in construction, efficient in the operation, inexpensive and easy to manufacture.

Yet another object and advantage of the present invention is that the ladder brace stabilizes the ladder adding security to the user with out fear of tipping or falling over while yet permitting safe outward reaching while standing on the ladder. The invention permits a broad margin of safety for sideways reaching by the individual by simply increasing the ladder base width.

DETAILED DESCRIPTION

Figures 1, 2, 6A, 6B:
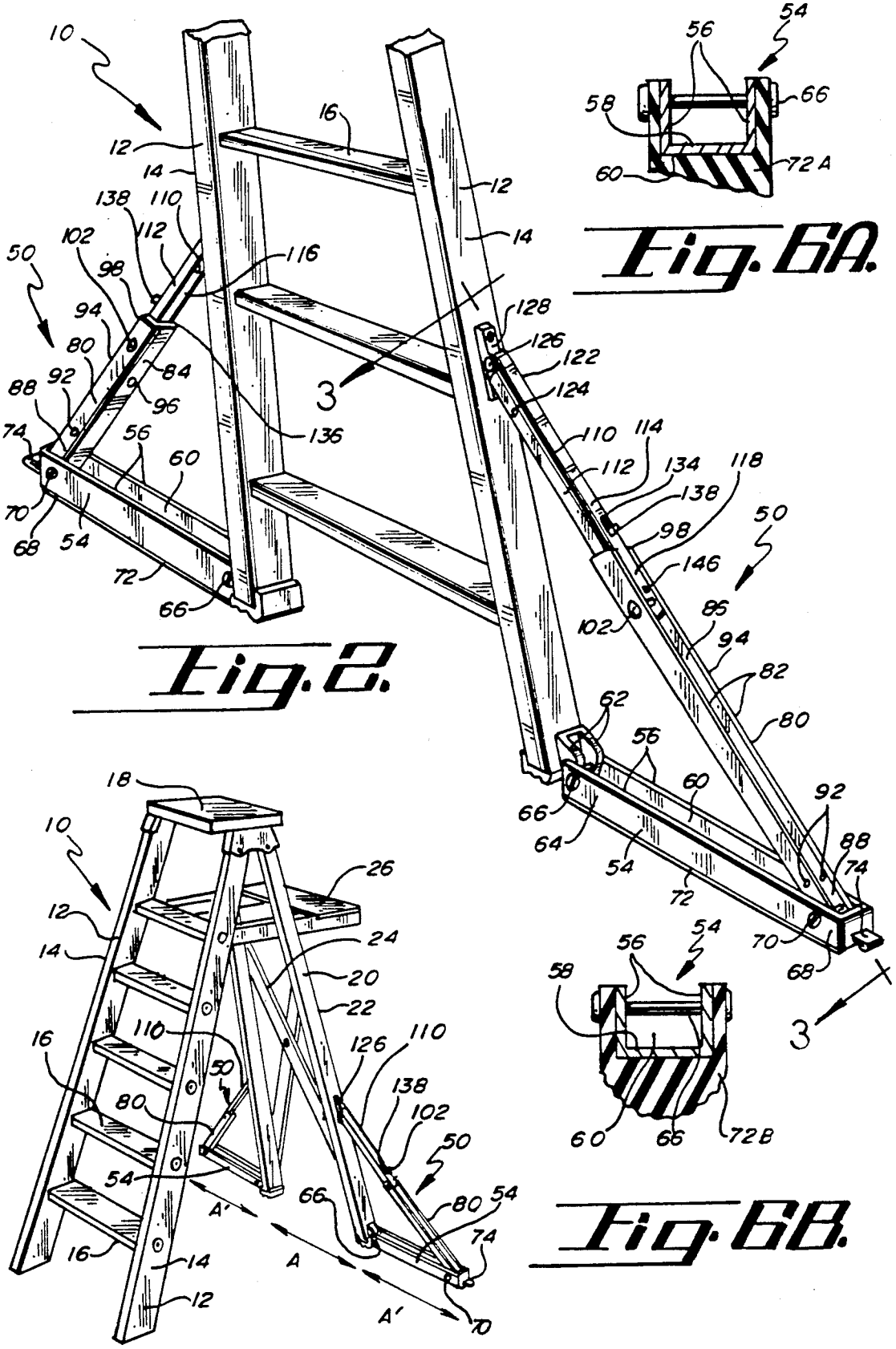
FIG. 1 is a perspective view of a step ladder in its extended position including the foot actuated ladder brace of the present invention mounted on the ladder's stabilizing brace.
FIG. 2 is a perspective view of the step ladder partially broken away and taken from the stabilizing brace including the foot actuated ladder brace of the present invention mounted on the stabilizing brace.
FIG. 6*a* is a cross sectional view of the foot link taken along lines 6*a*—6*a* of FIG. 3 showing one variation of ground gripping tread.
FIG. 6*b* is a cross sectional view taken along lines 6*b*—6*b* of FIG. 3 showing another variation of ground gripping tread.
Figure 11:
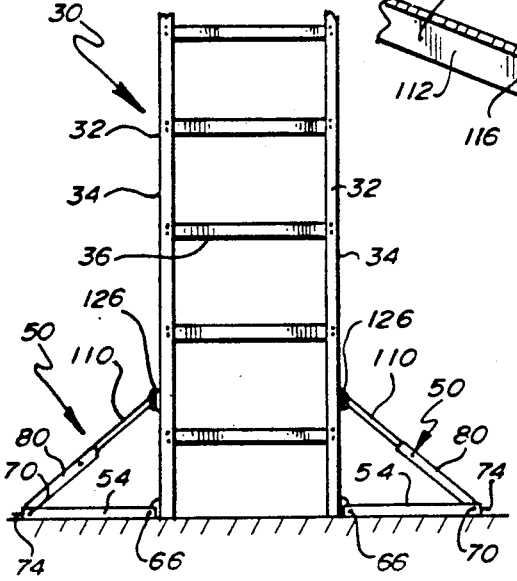
FIG. 11 is a front elevational view of the foot actuated ladder brace mounted on an an extension ladder partially broken away.

Referring to FIGS. 1, 2 and 11, a step ladder 10 suitably may be made of aluminum or wood. Ladder 10 includes rails 12 which have outward sides 14. Between walls 12 are rungs or steps 16. At the top of rails 12 is a top platform 18 with pivotal connections for rails 12 and a stabilizing brace 20. Stabilizing brace 20 has rail sides 22 also along with reinforcing or criss-crossing supports 24. A horizontal pail holder and brace 26 is also optional on many step ladders 10. As can be seen in FIG. 1, step ladder 10 has a ladder base A which foot actuated ladder brace 50 expands to A' plus A. An extension ladder 30 also has rails 32 with sides 34 and connecting rungs or steps 36 which are essentially like that of step ladder 10 without the stabilizing brace 20.

Referring to FIGS. 1-7, the foot actuated ladder brace 50 generally is comprised of three pivotally connected links 54, 80 and 110, which by foot actuated means 74, 100, 136 and 138, may be extended, locked and/or folded together.

More specifically, foot actuated ladder brace 50 has a foot link 54 which is U-shaped in cross section or channel shaped suitably made out of sturdy metal such as steel or aluminum. Foot link 54 includes walls or flanges 56 and base 58 between which is recess 60. A pair of raised, opposing ears 62 with apertures are mounted onto the rails sides 14 at the bottom or base of the ladder 10 such as by screws or rivets. The inner or ladder end 64 of foot link 54 has a pin or rivet 66 therethrough which is interlocked with the ears 62 to permit upward and downward pivoting of the foot link 54 from along the side rail 14 to along the extended ladder base A'. The outer end 68 of foot link 54 has an outer foot link pivot or pin 70 fixed thereat.

The outer walls 56 and base 58 of foot link 54 suitably may have an elastomeric ground gripping tread 72, 72*a* or 72*b* of various constructions (FIGS. 6*a* and 6*b*) to further stabilize the ladder 10 and prevent ladder slippage or collapse. At the outer end 68 of the links 54 is a tab 74 which protrudes outwardly as to be readily accessible by the typical human foot or shoe F. A foot peg recess 76 is also located in base 58 of foot link 54 which will be appreciated later.

Intermediate link 80 is also suitably U-shaped in cross section or channel shaped and is of a slightly smaller size than that of foot link 54. Intermediate link 80 includes walls 82 and base 84 which surround a recess 86. Intermediate link 80 has a foot end 88 with apertures therethrough for the outer foot link pivot 70 to pass therethrough. By this arrangement, foot link 54 and intermediate link 80 are pivotally connected. Adjacent the foot end 88 are inward detent dimples 92. Intermediate section 94 has a foot peg aperture 96 therethrough as will be appreciated later. Inward end 98 has a protruding tongue 100 which may be rigidly formed from the upturning of a section of the base 84 of the intermediate link 80. Tongue 84 comprises part of the foot actuated locking means. Adjacent the inward end 98 is also located ladder link pivot or pin 102.

The upper or ladder link 110 is of the smallest channel shape or U-shaped cross section construction. Ladder link 110 has walls 112 and base 114 which surround recess 116. The outer end 118 of ladder link 110 has apertures 120 for passing the upper ladder link pivot 102 of the intermediate link 80 therethrough. By this arrangement, intermediate link 80 and ladder link 110 are pivotally connected. Ladder link 110 has a ladder end 122 adjacent which are detent inwardly dimples 124 as will be appreciated later. At the ladder end 122 is an upper link pivot or pin 126 which passes through a pair of upper opposing raised ears 128 suitably affixed to the ladder side rails 14 as by screws or rivets.

Referring to the foot actuated locking and folding means, the outer end 118 of the ladder link 110 has an inwardly projecting ear or spring anchor 130 upon which is attached coil spring 132. There is a slot 134 in base 114 somewhat adjacent the outer end 118 of ladder link 110. Below the slot 134 is a sliding tongue catch 136 which has a foot peg 138 projecting upwardly and outwardly as well as being fixed on or in the catch 136. Foot peg 138 protrudes through slot 130 and is held thereat by shoulder 140 which suitably and slidably interlocks the sliding tongue catch 36 just below slot 34. Tongue catch 36 has tongue notches 42 which are suitably interlockable with the protruding tongue 100 of intermediate link 80 to hold intermediate link 80 and ladder link 110 rigidly together. Tongue catch 36 also has an ear spring anchor 146 which catches spring 132 to bias the tongue notches 142 into engagement with protruding tongue 100. When ladder link 110 is locked with intermediate link 80, foot link 59 is held firmly along ladder base A and A'.

The construction and operation of the foot actuated ladder brace 50 may now be truly appreciated. The channel shaped construction of foot link 54, intermediate link 80 and ladder link 110 are of a decreasing size from large to small as to permit the links to nest within each other. That is, the ladder link 110 will nest within the intermediate link 80 which will in turn nest within the foot link 54. For this to occur, the foot link should be somewhat longer than the intermediate link 80 which also should be somewhat longer than the upper ladder link 110. Strictly for illustration purposes, the foot link 54 may be 13 to 14 inches. The intermediate link 80 may be 11 to 12 inches. The ladder link 110 may be 9 to 10 inches.

Figure 7:
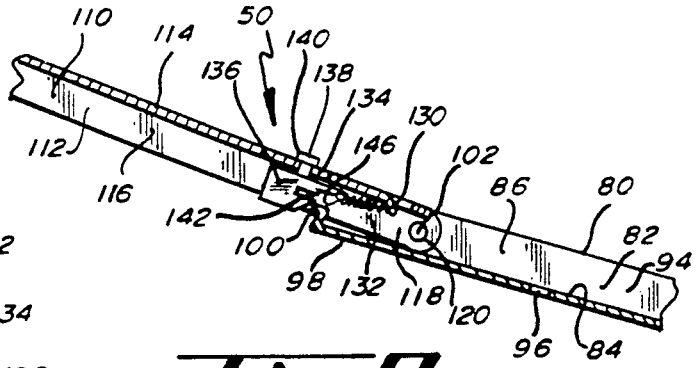
FIG. 7 is similar to FIG. 3 showing the intermediate and ladder links just beginning to fold after being released from their extended and secured position.
Figure 4:
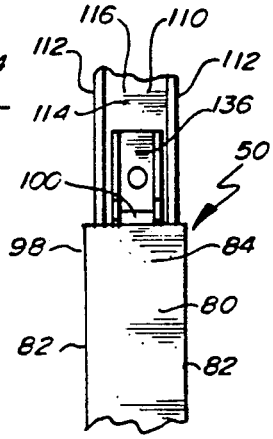
FIG. 4 is a view of the foot actuated ladder brace taken along lines 44 of FIG. 3 partially broken away.
Figure 5:
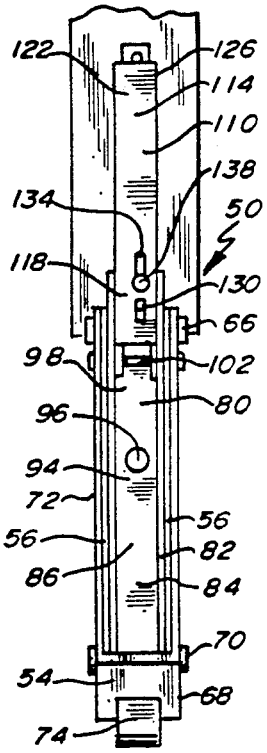
FIG. 5 is a view of the foot actuated ladder brace taken along lines 5—5 of FIG. 3 and being partially broken away.
Figure 3:
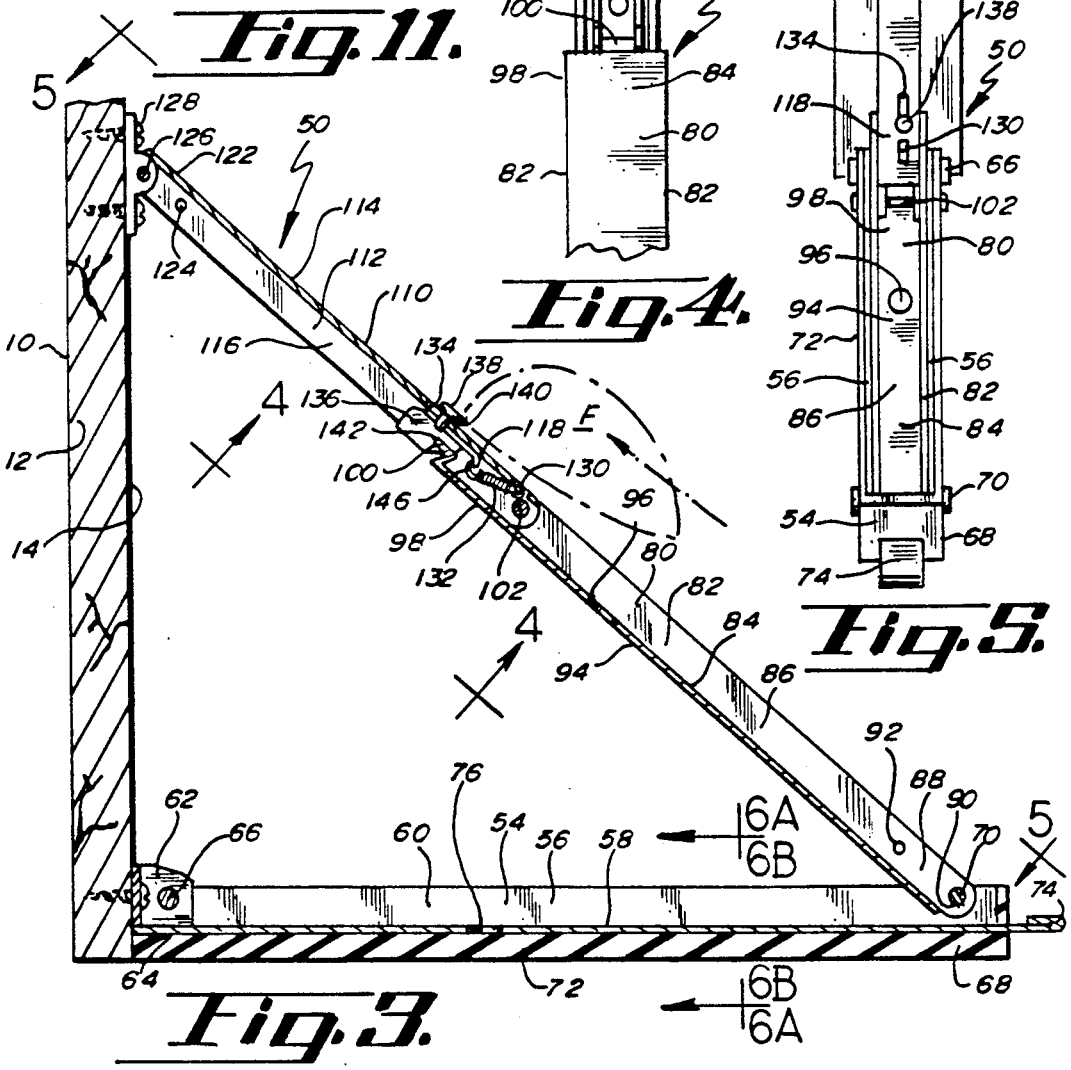
FIG. 3 is/a cross sectional view taken along lines 3—3 of FIG. 2.
Figure 8:
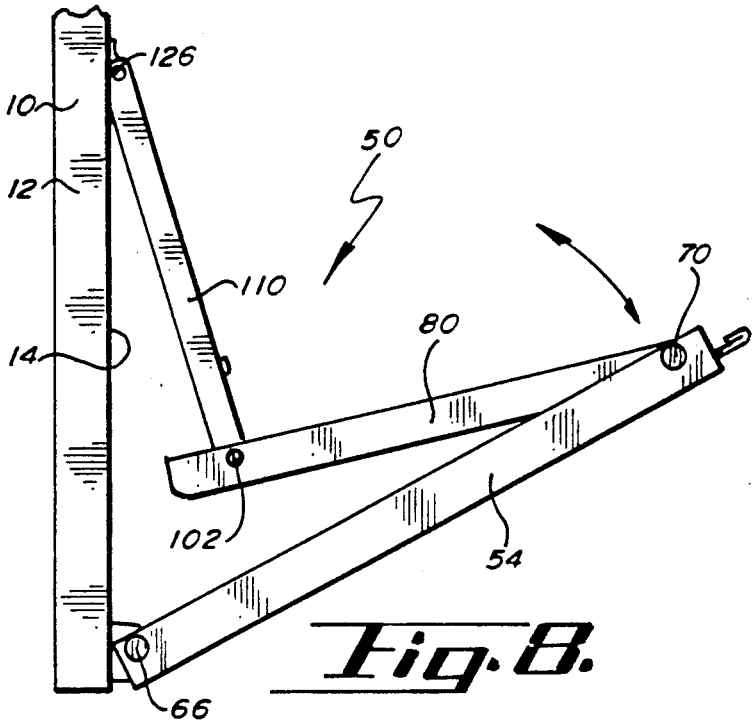
FIG. 8 is a front elevational view of the ladder beginning to fold from its previous position in FIG. 7.
Figure 9:
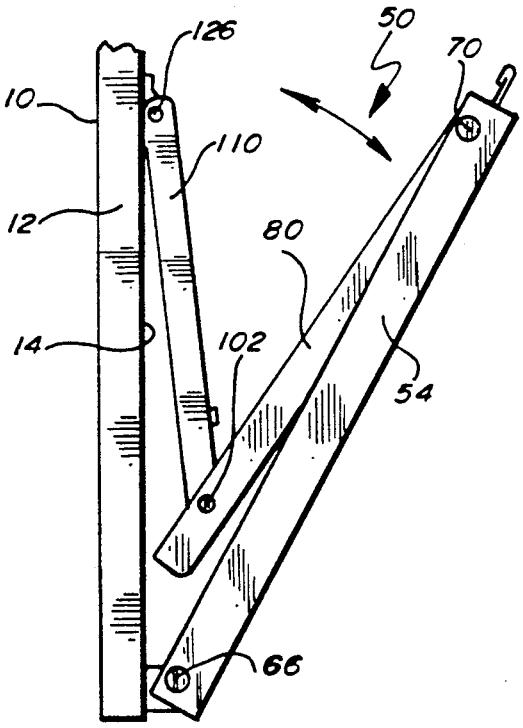
FIG. 9 is a front elevational view of the ladder brace further being folded from its position shown in FIG. 8.
Figure 10:
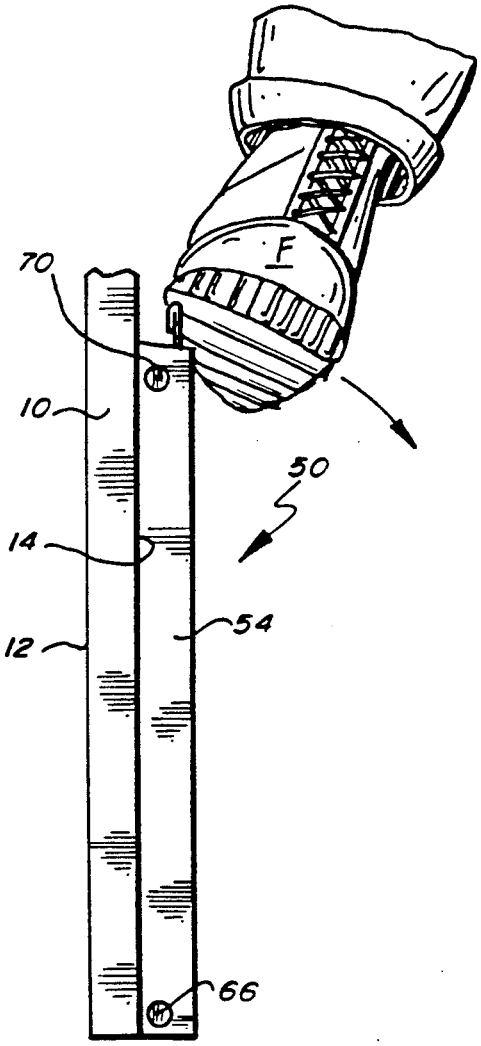
FIG. 10 is a front elevational view of the ladder brace in its folded condition.

Referring to all the figures, FIG. 10 shows the foot actuated ladder brace 50 in its upwardly folded position along the side rails 14. Tab 74 protrudes upwardly and outwardly from the foot link 54 which is readily accessible to an individual's foot F as it is somewhat space from side rail 14. Remembering that cooperating detent dimples 92 of intermediate link 80 and detent dimples 124 of ladder link 110 are slidably engaged when the ladder brace is in its upward folded position, the foot F exerts some downward and outward force to move the foot link 54 in the direction of the arrow shown in FIG. 10. The tab 74 is continued to be moved downwardly as the brace 50 begins to pivot and unfold as shown in FIGS. 9, 8 and 7. FIG. 7 shows a cross section of the intermediate link 80 and the ladder link 110 just before the interlocking of the tongue notches 142 with the protruding tongue 100. The biasing of tongue catch 136 permits the tongue 100 to snap and lock into position within notches 142 thereby releasably and rigidly interlocking the intermediate link 80 and ladder link 110 as shown in FIG. 3.

To fold up the foot actuated ladder brace 50, the person takes his foot F and moves the foot peg 138 and catch 136 upwardly and out of biased engagement as between protruding tongue 100 and tongue notches 142. Immediately thereafter, the ladder link 110 and intermediate link 80 begins to fold downwardly and inwardly as shown in FIG. 7 and progressively to FIG. 8. Thereafter, the individual may take his foot and continue to fold the foot actuated ladder brace 50 into its folded up position by moving the foot link 54 toward the side rail 14 by engaging the tab 74 with the foot F. Eventually, detents 92 and 124 will interlock while foot peg 138 passes through aperture 96 and into recess 76. Thereafter the ladder may either be folded and/or transported.

It can be appreciated that the foot actuator ladder brace 50 may be fastened on either the stabilizing brace 20 of the step ladder 10 or along the immediate rail sides 14 of the ladder 10. FIG. 11 shows that the foot actuated ladder brace 50 is also readily attachable to the side rails 34 of an extension ladder 30 which suitably has rails 32 and rungs 36 therebetween. The elastomeric ground gripping tread 72*b* (FIG. 6*b*) is ideal for an extension ladder 30 (FIG. 11). The elastomeric ground gripping tread 72*a* (FIG. 6*a*) is ideal for a step ladder 10 (FIGS. 1 and 2).

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

WHAT IS CLAIMED:

1. A foot actuated ladder brace for stabilizing ladders with side rails by increasing the ladder base width, comprising:

(a) a channel-shaped foot link with inner and outer ends, the inner end being pivotally connected to the bottom of one of the side rails as to fold up along the side rail and to swing downwardly to extend along and to increase the ladder base.

(b) a smaller channel-shaped intermediate link adapted to nest within the foot link having a foot end pivotally connected to the outer end of the foot link and an inward end;

(c) a smallest channel-shaped ladder link adapted to nest within the intermediate link having a ladder end pivotally connected to the one side rail above the bottom and an outer end pivotally connected to the intermediate link adjacent to the inward end of the intermediate link; and (d) a foot actuated extending, locking and folding means for extending the foot link from its foldup position to its extended position along the ladder base, for rigidly interlocking the links together, for releasing the interlocked links and for nesting and folding the links upwardly along the side rail.

2. The foot actuated ladder brace of claim 1 wherein the foot link is longer than the intermediate link and the intermediate link is longer than the ladder link.

3. The foot actuated ladder brace of claim 1 wherein the foot link has an elastomeric ground gripping tread.

4. The foot actuated ladder brace of claim I wherein the foot actuated extending means comprises a tab extending from the outer end catchable by a foot to move the brace from its folded position to its extended position.

5. The foot actuated ladder brace of claim 1 wherein the locking means comprises a rigid protruding tongue extending from the inward end of the intermediate link and a tongue catch slidably mounted on the ladder link to securely and rigidly hold the links in their extended position.

6. The foot actuated ladder brace of claim 5 wherein the catch is biased to interlock with the tongue.

7. The foot actuated ladder brace of claim 6 wherein the folding means comprises a foot peg mounted on the catch and catchable by a foot to release the link locking means to permit the brace to be folded upwardly along the side rail by moving the brace with the foot.

8. The foot actuated ladder brace of claim 1, further comprising a securing means to hold the ladder brace in its fold up position.

9. The foot actuated ladder brace of claim 1, wherein the securing means comprises interlockable and matching detent dimples on the intermediate and the ladder links.

10. A foot actuated ladder brace for stabilizing ladders with side rails by increasing the ladder base width, comprising:

(a) a channel-shaped foot link with inner and outer ends, the inner end being pivotally connected to the bottom of one of the side rails as to fold up along the side rail and to swing downwardly to extend along and to increase the ladder base.

(b) a smaller, shorter channel-shaped intermediate link adapted to nest within the foot link having a foot end pivotally connected to the outer end of the foot link and an inward end;

(c) a smallest and shortest channel-shaped ladder link adapted to nest within the intermediate link having a ladder end pivotally connected to the one side rail above the bottom and an outer end pivotally connected to the intermediate link adjacent to the inward end of the intermediate link; and (d) a foot actuated extending, locking and folding means for extending the foot link from its folded up position to its extended position along the ladder base, for rigidly interlocking the links together, for releasing the interlocked links and for nesting and folding the links upwardly along the side rail; wherein the foot actuated extending means comprises a tab extending from the outer end catachable by a foot to move the brace from its folded position to its extended position and wherein the locking means comprises a rigid protruding tongue extending from the inward end of the intermediate link and a tongue catch slidably mounted on the ladder link to securely and rigidly hold the links in their extended position.

11. The foot actuated ladder brace of claim 10 wherein the catch is biased to interlock with the tongue.

12. The foot actuated ladder brace of claim 11 wherein the folding means comprises a foot peg mounted on the catch and catchable by a foot to release the link locking means to permit the brace to be folded upwardly along the side rail by moving the brace with the foot.

13. The foot actuated ladder brace of claim 10, further comprising a securing means to hold the ladder brace in its fold up position.

14. The foot actuated ladder brace of claim 13, wherein the securing means comprises interlockably and matching detent dimples on the intermediate and the ladder links.

15. A foot actuated ladder brace for stabilizing ladders with side rails by increasing the ladder base width, comprising:

(a) a channel-shaped foot link with inner and outer ends, the inner end being pivotally connected to the bottom of one of the side rails as to fold up along the side rail and to swing downwardly to extend along and to increase the ladder base.

(b) a smaller, shorter channel-shaped intermediate link adapted to nest within the foot link having a foot end pivotally connected to the outer end of the foot link and an inward end;

(c) a smallest and shortest channel-shaped ladder link adapted to nest within the intermediate link having a ladder end pivotally connected to the one side rail above the bottom and an outer end pivotally connected to the intermediate link adjacent to the inward end of the intermediate link; and (d) a foot actuated extending, locking and folding means for extending the foot link from its folded up position to its extended position along the ladder base, for rigidly interlocking the links together, for releasing the interlocked links and for nesting and folding the links upwardly along the side rail; wherein the foot actuated extending means comprises a tab extending from the outer end catachable by a foot to move the brace from its folded position to its extended position and wherein the locking means comprises a rigid protruding tongue extending from the inward end of the intermediate link and a tongue catch slidably mounted on the ladder link biased to engage the tongue to securely and rigidly hold the links in their extended position and wherein the folding means comprises a foot peg mounted on the catch and catchable by a foot to release the link locking means to permit the brace to be folded upwardly along the side rail by moving the brace with the foot wherein the locking means comprises a rigid protruding tongue extending from the inward end and a tongue catch slidably mounted on the ladder link to securely and rigidly hold the links in their extended position.

* * * * *

UNITED STATES PATENT AND TRADEMARK OFFICE

CERTIFICATE OF CORRECTION

PATENT NO. : 5,086,876

DATED : February 11, 1992

INVENTOR(S) : Gary E. Severson

It is certified that error appears in the above-identified patent and that said Letters Patent is hereby corrected as shown below:

Column 2, line 16, delete "is/a" and insert --is a--.

Column 2, line 19, delete "44" and insert --4-4--.

Signed and Sealed this

First Day of June, 1993

*Attest:*

Michael K. Kirk

MICHAEL K. KIRK

*Attesting Officer*

*Acting Commissioner of Patents and Trademarks*